United States Patent [19]

Shibata

[11] 4,429,458

[45] Feb. 7, 1984

[54] METHOD FOR MAKING COMPOSITE ELECTRICAL CONTACT WELDED IN SITU TO SUPPORTING METAL, AND APPARATUS THEREFOR

[75] Inventor: Akira Shibata, Yokohama, Japan

[73] Assignee: Chugai Denki, Kogyo K.K. of Tokyo, Japan

[21] Appl. No.: 217,860

[22] Filed: Dec. 18, 1980

[30] Foreign Application Priority Data

Dec. 29, 1979 [JP] Japan ..... 54-170893

[51] Int. Cl.[3] ..... H01R 43/02

[52] U.S. Cl. ..... 29/879; 10/25; 29/875; 29/882; 72/335; 228/3.1; 228/5.1

[58] Field of Search ..... 228/3.1, 4.1, 5.1; 29/875, 882, 876, 877; 72/339, 335; 10/25

[56] References Cited

U.S. PATENT DOCUMENTS

| | | | |
|---|---|---|---|
| 3,031,908 | 5/1962 | Lejdegard | 10/25 X |
| 3,199,176 | 8/1965 | Freudiger et al. | 29/875 |
| 3,359,623 | 12/1967 | Gwyn, Jr. | 29/875 X |
| 3,397,454 | 8/1968 | Gwyn, Jr. | 228/3.1 X |
| 3,460,735 | 8/1969 | Shibata | 72/335 X |
| 3,605,262 | 9/1971 | Shibata | 29/882 X |
| 3,606,680 | 9/1971 | Shibata | 29/882 X |
| 3,634,934 | 1/1972 | Fitzgerald | 228/4.1 X |
| 3,932,936 | 1/1976 | Harmsen et al. | 29/875 |
| 4,232,812 | 11/1980 | Shibata | 228/3.1 |

*Primary Examiner*—Francis S. Husar
*Assistant Examiner*—Carl J. Arbes
*Attorney, Agent, or Firm*—Shlesinger, Fitzsimmons & Shlesinger

[57] ABSTRACT

Immediately after a composite electric contact is made from wires by cold welding and in a manner as it has been cold welded, it is brought onto a supporting metal and subjected to pressure and resistance heat exerted by a pair of electrodes whereby the contact and the supporting metal are spot welded in situ without adversely affecting the supporting metal such as warping thereof and whereby cold welded abutting ends of the contact are released from stress which is produced by cold welding and the contact is annealed in whole.

5 Claims, 10 Drawing Figures

Figure 1:
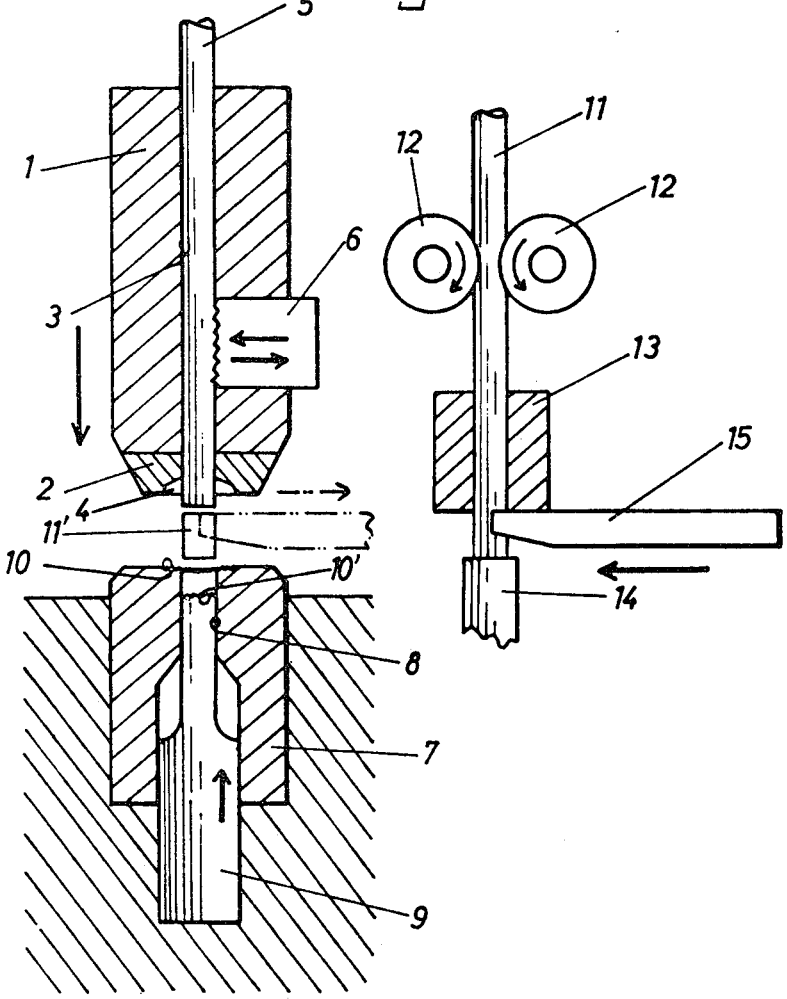

METHOD FOR MAKING COMPOSITE ELECTRICAL CONTACT WELDED IN SITU TO SUPPORTING METAL, AND APPARATUS THEREFOR

This invention relates to a method of making a composit electrical contact which is welded in situ to a supporting metal, and it also relates to an apparatus which is preferably employable for practicing said method.

The electrical contact which is made in this invention is a composite electrical contact consisting of a contact portion and a base portion which are bonded together along their abutting surfaces by cold pressure welding. Said contact portion is made from a silver alloy which is internally oxidized and dispersed with oxides of Cd, Sn, Zn, Fe, In, Bi and so on or powder metallurgically made silver alloys which contain metal carbides such as tungsten carbide, carbons such as graphite, and so on. This contact portion is not weldable to other metals by spot welding method, but weldable by cold welding method. On the other hand, the base portion is made from silver, alloys thereof, copper, or alloys thereof which are cold weldable, have high contact resistance and specific resistance, and do not form any oxidation film about their welded surfaces.

The composit electrical contact of the above-mentioned kind is often used as the one which is fitted to a support or back metal made from copper, alloys thereof, or ferrous materials such as stainless steel, spring steel and so on. However, conventional methods of fabricating said contact into the one which is welded onto a supporting metal are accompanied with a lot of difficulties, and their employment is therefore limited.

To wit, in order to weld said composite electrical contact onto a supporting metal, the contact has to be annealed beforehand in a step entirely different and independent from the welding step. This makes it impossible to keep the contact entirely fresh and clean as it is produced, since it comes to be in a mess of other contacts. it is really pains-taking though not impossible to distinguish between the contact portion and the base portion of such contact in a mess. And, it needs very precise workmanship to have such contact of small dimensions spot welded or projection welded one by one exactly at a desired position on a supporting metal, without misplacing its contact and base portions. Though this operation is not impossible, it can hardly be employed in mass production. Hence, tape welding method is conventionally employed, but this method is not economical since it is accompanied with waste of expensive materials. There is another conventional method, in which the base portion of a composite contact particularly of rivet type is passed through a perforation provided to a supporting metal plate, and the freed end of said base portion is calked to the supporting metal plate. This method involves comparatively high assembling costs, and it is accompanied with a drawback that the calking increases the thickness of a contact assembly.

This invention has solved those drawbacks and disadvantogeous points which are mentioned above in connection with the conventional methods, and provides a novel method for welding a composite electrical contact of the aforementioned kind onto a supporting metal plate readily in sequence and effectively, and it provides also an apparatus which is adequate to perform said method. Other efficiencies and advantages of this invention shall be made apparant hereinunder.

This invention method can be briefed as follows.

A short wire material which shall make up the contact portion of a composite contact, and another short wire material which is for the base portion are aligned coaxially, and subjected to axial pressure so that their abutting ends are cold welded. The composite contact thus made is immediately transferred above a supporting metal plate, without being subjected to any other substantial step successive to said cold welding and without being annealed, and is positioned on the plate. Said composite contact and the supporting plate are sandwiched between a pair of electrodes under pressure so that they are spot welded by resistance heat between the electrodes. It is essential in this invention to place a major portion of the composite contact especially its cold welded abutting surfaces under restriction by one of the electrodes. This restriction by the electrode under pressure and heat brings about the release of stress of the contact which has produced when it was cold welded, and also increases the binding force between the contact and base portions. Said restriction works, in addition, to have the contact annealed, whereby the shaping of contact at a succeeding step, if any, can be easier.

Further in addition, as a contact is welded to a supporting metal by spot welding in this invention, no deformation or warp shall be produced on the supporting metal, whereby the stamping out of a supporting metal piece welded with the contact from the continuous supporting metal plate can precisely be made.

As an embodiment of this invention, bottom surface of the base portion of contact is made rough when said portion is cold welded to the corresponding contact portion. Such roughness increases the hardness of said bottom surface and, consequently its weldability to other metals.

In the drawing which illustrates this invention;

FIGS. 1–10 are explanatory sectional views of a series of devices which are employed to perform this invention method.

A punch 1 which serves also as upper electrode has a forward part 2 made from tungsten carbide and so on. The said punch is axially provided with a through hole 3, and it is provided also at said forward 2 with a cavity 4, configuration of which is correspondent to a contact portion of the electrical contact to be made. The punch is further provided with clamp means 6 which hold or release a wire material 5 for the contact portion against and from the punch, said wire material being moved through the hole 3 intermittently by a predetermined distance. A shank die 7 (FIGS. 1 and 2) which is placed so as to confront the punch 1, has a hole 8 which is coaxial with the through hole 3 of the punch 1. In this hole 8, there is provided a pin 9 which is reciprocally movable within said hole. The punch 1 can move downwardly in FIG. 1 to an operative position where it is about to abut against the shank die 7. Upper outer surface of the shank die 7 and free end of the pin 9 are made rough with notches 10, 10'.

Feedng means 12, 13, 14 of a wire material 11 for the base portion of composite electrical contact is positioned a distance from the punch 1 and shank die 7. The axis of feeding means is parallel with the common axis of the punch 1 and shank die 7. The wire material 11, which is intermittently fed by a pair of rollers 12, passes through a cutting pipe 13, and advances till it abuts against a stopper 14. The free end of said stopper 14 lies on the level same to the outer surface 10 of the shank die 7. Numeral 15 indicates a cutting or shearing knife, the upper edge of which makes slidable contact with the lower edge of the cutting pipe 13 so as to cut from the wire 11 a piece 11' of the desired length. The shearing knife, which works also to pinch the wire 11' thus cut, advances to its broken line position as shown in FIG. 1, and thus carries the short cut wire 11' to the gap between the punch 1 and the shank die 7.

By means of the feeding means for the wire material 11 and by means of the punch and shank die, constructions of all of which are explained above, the wire material 5 which forms the contact portion of composite electrical contact and the short cut wire 11' which forms the base portion of said contact, are thus aligned coaxially in a space between the punch and the shank die, as illustrated in FIG. 1.

When they are thus aligned, the wire material 5 is kept unmovable with respect to the punch by means of the clamp means 6. Then, as illustrated by the arrows in FIG. 2, the punch 1 is lowered toward the shank die, while the pin 9 of shank die is simultaneously elevated toward the die and the cutting knife 15 is returned at this time to its original position.

Figure 2:
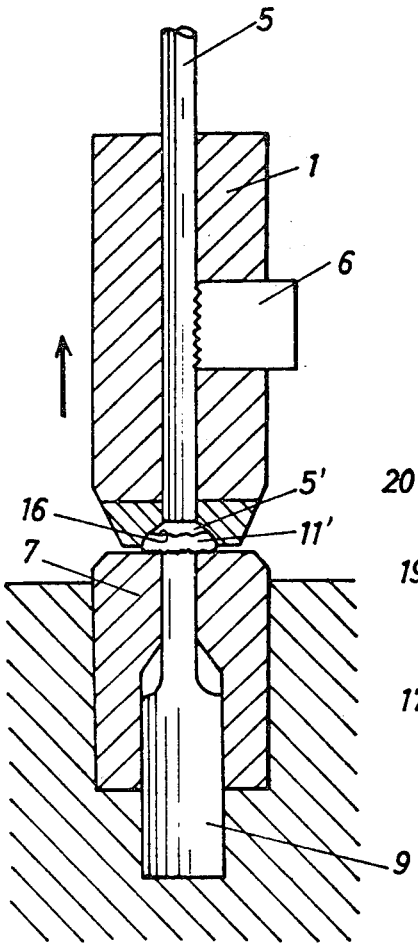
Figure 3:
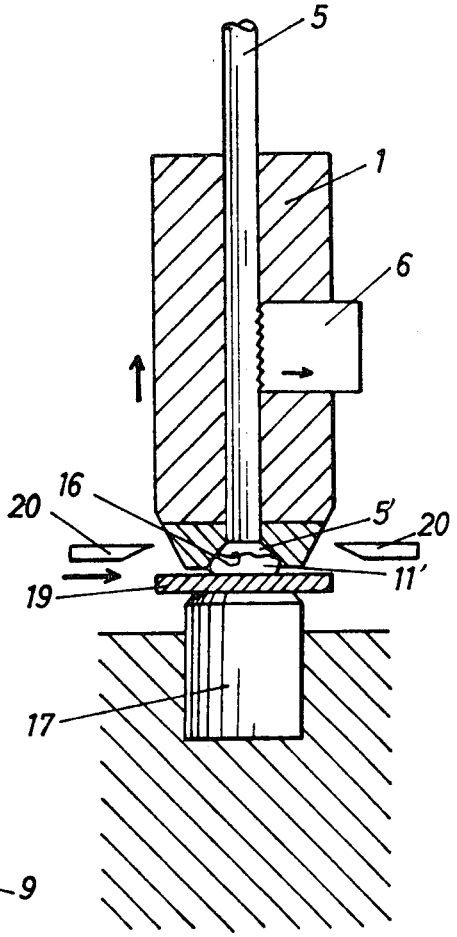

The forward or lower end of the wire material 5, which is held stationary against the punch by means of the clamp means, and the short cut wire 11' are thus pressed as shown in FIG. 2 between the punch and the shank die and pin thereof, whereby they are subjected to large plastic deformation about their abutting surface 16 and cold welded, resulting in producing a composite electrical contact 5'. It shall be noted that said contact comes to have at its lower surface roughness. Then, the punch 1 carrying the wire material 5 which is formed at its forward end with the composite electrical contact is lifted slightly upward. In FIG. 3, numeral 17 is a lower electrode upon which an elongated sheet of supporting metal 19 provided with holes 8 for fitting the metal to an electrical appliance is intermittently moved.

The punch 1 which works also as the upper electrode and carries the contact 5', and the lower electrode 17 with the supporting metal sheet 19 thereupon are brought to confront to each other, as for example by shifting punch 1 to a second station in which it overlies the lower electrode 17 and the metal plate 19, as shown for example in FIG. 3. The punch is lowared toward the sheet 19 so that the composite electrical contact carried by the punch abuts at its lower rough surface against the supporting metal sheet 19 at a desired position thereof. The punch 1 and the lower electrode 17 are charged (for example, under a pressure of about 18 Kg and with an electric current of about 5,000 A), whereby the heat produced by resistance between the base portion 11' of the composite contact 5' and the supporting metal 19 weld them. Simultaneously with this welding, the composite electrical contact which is rigidly held within the cavity 4 of the punch 1 as it has been since it was cold welded, is also subjected to the resistance heat and pressure, whereby stress produced about the cold bonded surface 16, when the contact was welded is released and the contact in whole is annealed.

Numerals 20, 20 are a pair of knives which advance and retract toward and away from the wire material 5 for cutting the composite contact 5' from said wire material 5.

Figure 4:
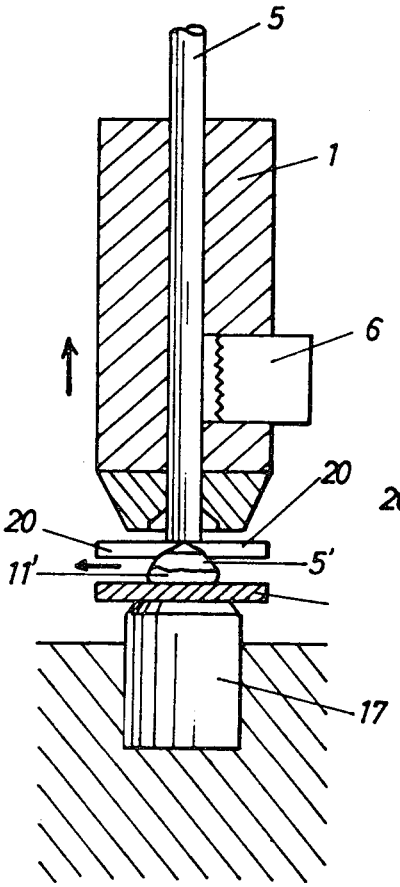
Figure 5:
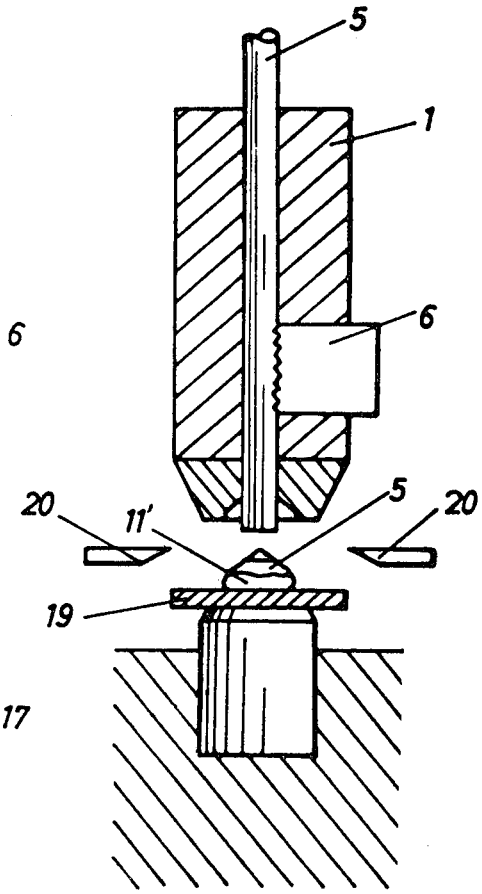
Figure 6:
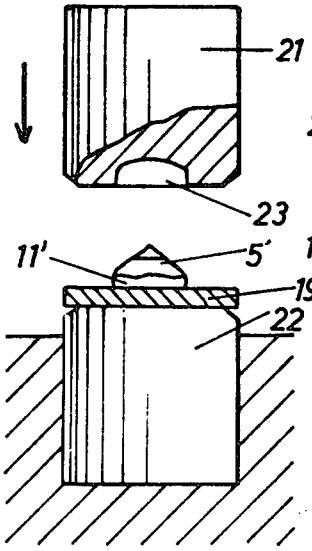

When the composite electrical contact is resistance welded to the supporting metal 19, the clamp means 6 which has bound the wire material 5 to the punch is released from the wire. And, then, as shown in FIGS. 4 and 5, the punch is further slightly lifted above, while the knives 20, 20 advance toward each other to abut on the top of contact and to cut off the contact from the wire 5. The clamp means 6 binds the wire to the punch, again, and the punch is lowered and returned to its original position, as shown in FIG. 1.

Figure 7:
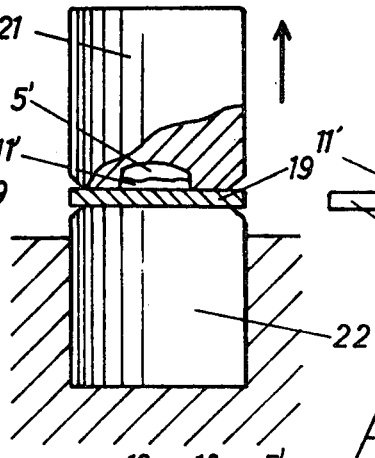
Figure 8:
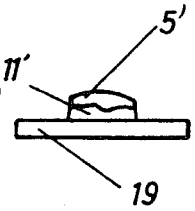

The strip-like supporting metal with the composite contact welded thereonto advances onto a lower die 22 which faces to an upper die 21 having a cavity 23 which corresponds to a final shape of the contact. And, as illustrated in FIG. 7, the lowering of the upper die 21 till it reaches the lower die 22 has the contact shaped as shown in FIG. 8. This shaping operation is readily and accurately made, since the contact has been annealed by that time.

Figure 9:
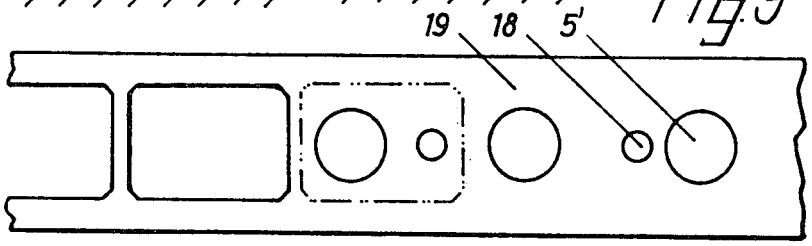
Figure 10:
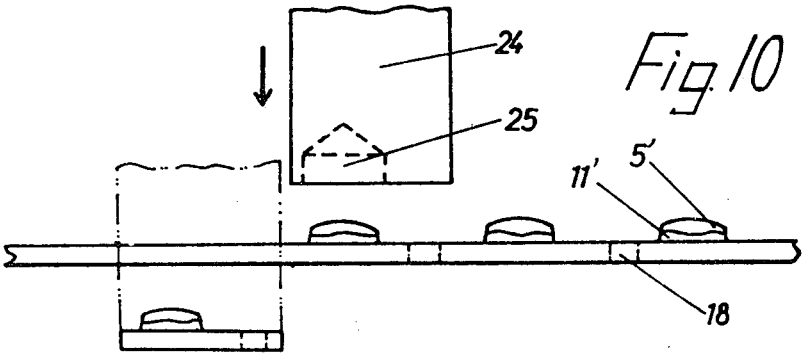

The supporting metal sheet is cut off to contact units by means of punch 24, as shown in FIGS. 9 and 10. Numeral 25 indicates a hollow provided to the free end of punch 24, which hollow prevents the contacts 5', 11' from breakage when the punch is pressed down.

What is claimed is:

1. A method of making a composite electrical contact having a metallic contact portion and a metallic base portion cold welded to the contact portion, said composite electrical contact being welded to a metal support, said method comprising, positioning a wire of a first metallic material for the contact portion and a wire of a second metallic material for the base portion coaxially in alignment, cold welding together the confronting ends of said wires by subjecting them to pressure between a punch and die along their axial directions thereby to form a composite contact, positioning said composite contact onto a metal support so as to make the base portion of the contact abut against a desired site on said support immediately after said cold welding, placing said composite contact and the metal support between a pair of charged electrodes, one of which comprises said punch, and resistance welding said contact to said support while restraining the cold welded ends of said wires in a recess in one of the confronting ends of said electrodes, and in such manner that the resistance heat between the electrodes, which welds the contact to the metal support, anneals the contact and releases any stress which was produced when said confronting ends of said wires were cold welded.

2. The method as claimed in claim 1, including causing the pressure applied to the wires along their axial directions for cold welding their confronting ends to produce roughness at the bottom surface of the base portion of the contact, and applying pressure to the contact by the electrodes sufficient enough to deform said roughness.

3. The method as to defined in claim 1, including shaping the contact into final form after the resistance welding of the contact to said support.

4. The method as defined in claim 1, including feeding said wire of a first metallic material through an axial bore in one of said electrodes.

5. The method as defined in claim 4, including restraining the cold welded ends of said wires in a recess in said punch during the resistance welding of said confronting ends of said wires.

* * * * *